US005325154A

United States Patent [19]

Tayama et al.

[11] Patent Number: 5,325,154

[45] Date of Patent: Jun. 28, 1994

[54] COLOR PRINTER USING CIRCULATION PERIOD TO CONTROL REGISTRATION OF IMAGES

[75] Inventors: Hideo Tayama; Kenichi Akahori, both of Hitachi, Japan

[73] Assignee: Hitachi, Ltd., Tokyo, Japan

[21] Appl. No.: 865,796

[22] Filed: Mar. 30, 1992

Related U.S. Application Data

[63] Continuation of Ser. No. 608,470, Nov. 2, 1990, abandoned.

[30] Foreign Application Priority Data

Nov. 7, 1989 [JP] Japan ..... 1-287923

[51] Int. Cl.[5] ..... G03G 21/00; G03G 15/01

[52] U.S. Cl. ..... 355/208; 346/157; 355/272; 355/326 R

[58] Field of Search ..... 355/326, 327, 272, 204, 355/208, 275, 281; 346/157

[56] References Cited

U.S. PATENT DOCUMENTS

| | | | |
|---|---|---|---|
| 3,779,639 | 12/1973 | Tamai | 355/327 |
| 4,025,182 | 5/1977 | Goel | 355/275 |
| 4,365,888 | 12/1982 | Hosaka et al. | 355/208 |
| 4,531,828 | 7/1985 | Hoshino | 355/272 X |
| 4,705,385 | 11/1987 | Palm et al. | 355/327 |
| 4,705,386 | 11/1987 | Ogita et al. | 355/327 |
| 4,766,463 | 8/1988 | Watanuki | 355/272 |
| 4,873,548 | 10/1989 | Kobayashi et al. | 355/200 |
| 4,933,708 | 6/1990 | Asano et al. | 355/326 X |
| 4,937,635 | 6/1990 | Paxon et al. | 355/326 |
| 4,975,741 | 12/1990 | Tanaka | 355/208 X |
| 5,023,708 | 6/1991 | Maruyama et al. | 346/157 X |
| 5,025,269 | 6/1991 | Saeki et al. | 346/157 X |
| 5,130,748 | 7/1992 | Tanaka | 355/208 X |

FOREIGN PATENT DOCUMENTS

| | | | |
|---|---|---|---|
| 62-195687 | 8/1987 | Japan . | |
| 63-155147 | 10/1988 | Japan . | |
| 0142678 | 6/1989 | Japan | 355/327 |

*Primary Examiner*—A. T. Grimley
*Assistant Examiner*—Nestor R. Ramirez
*Attorney, Agent, or Firm*—Antonelli, Terry, Stout & Kraus

[57] ABSTRACT

A color printer of the type that prints color images by sequentially transferring from a photosensitive drum toner images of different colors in color registration to each other on a recording sheet being circulated by a conveyer belt, the color printer having an improved color registration capability. In order to avoid influences of variations in printer constants, such as elongation and contraction of the conveyer belt due to accumulated changes and temperature variations, etc., the position of the formation of a plurality of toner images of different colors on the recording medium is controlled with high precision by controlling the position or timing of formation of two successive toner images of different colors by detecting the recording sheet circulation period during the formation of the toner image of each color or by detecting the recording sheet circulation period directly preceding it.

12 Claims, 5 Drawing Sheets

COLOR PRINTER USING CIRCULATION PERIOD TO CONTROL REGISTRATION OF IMAGES

This application is a continuation of application Ser. No. 07/608,470, filed Nov. 2, 1990, now abandoned.

BACKGROUND OF THE INVENTION

The present invention relates to a color printer and in particular to improvement of color registration capability of a color printer, by means of which a color image is obtained by forming repeatedly toner images of different colors in improved color registration on a recording medium.

In a color printer, by means of which a color image is obtained by forming repeatedly toner images of different colors in color registration on a recording medium, color images are printed out of color registration unless the position of conveyance of the recording medium can be detected with high precision for the formation of the image of each color.

In particular, a color printer utilizing the electronic photographic technique is so constructed that a color image is obtained on a recording sheet by forming a toner image of a first color on a photosensitive body or photo-sensitive drum or the like, which image is transferred to the recording sheet and then forming a toner image of a second color on the photo-sensitive body, which image is transferred to the recording sheet in registration with the image of the first image. Images of a third, a fourth, etc. color are transferred thereon as needed in same way). Consequently, recording sheet conveying means should be able to convey a recording sheet repeatedly with a high precision, and control means should detect the conveyance position of the recording sheet with a high precision to form the toner image of each color.

For this reason control means, which detects the recording sheet conveyance position by linking an encoder with a driving motor in the recording sheet conveying means and which controls the toner image formation position on the basis of the result of the detection, and control means, which effects the rotation control of the photosensitive body and the conveyance control of the recording sheet in synchronism with a fundamental clock signal, have been proposed.

Such control means are disclosed e.g. in JP-Utility Model-A-Sho 63-155147 and JP-A-Sho 62-195687.

However, the control by such prior art control means has a problem in that it is difficult to form the toner images of different colors at the precise position, which gives rise to the formation of toner images out of color registration.

That is, by the technique disclosed in JP-Utility Model-A-Sho 63-155147 stated above, the conveyance position of the recording sheet is detected only indirectly, and it is impossible to eliminate the generation of out-of-color registration due to accumulation of changes the relative relation between the rotary encoder and the recording sheet conveying surface and variations in the temperature, which reduces the detection precision. In particular, in a system, in which the recording sheet conveying means is constituted by one or a plurality of rotating roller axes, around which belt-shaped means is wound, and a recording sheet is adhered thereon by static electricity, negative pressure of air, etc., such insufficient color registration is caused by the fact that the peripheral length of the belt-shaped means varies due to environmental variations in the temperature or the humidity, accumulated deviations, exchanges during maintenance, etc. On the other hand, by the technique disclosed in JP-A-Sho 62-195687, no attention is paid concerning the timing control of the generation of image data, and therefore it is difficult to form the toner images repeatedly at the precise position.

SUMMARY OF THE INVENTION

The object of the present invention is to form a plurality of toner images of different colors at a precise position in order to obtain improved color registration in a printed color image.

In order to achieve the above object, one aspect of a color printer according to the present invention comprises exposing means for generating a light beam modulated according to image data generated by image data generating means;

a photo-sensitive body adapted to be exposed by said exposing means to form an electrostatic latent image thereon;

developing means for developing the electrostatic latent image formed on said photo-sensitive body to form a toner image thereon;

conveying means for periodically circulating a recording medium, to which the toner image on said photo-sensitive body is transferred;

passage detecting means for detecting a particular portion conveyed by said conveying means passing through a predetermined position and for generating a passage detection signal; and control means including image data request signal generation means for sequentially generating and applying image data request signals to said image data generating means in synchronism with the periodical circulation of said medium which is circulated periodically a plurality of times, whereby electrostatic latent images of toner images of different colors are formed sequentially on said photo-sensitive body by controlling said exposing means according to image data generated by said image data generating means responsive to the applied image data request signals respectively, each of the electrostatic latent images is developed to form a toner image of different color, which toner image is transferred to said recording medium to form a color image thereon;

wherein said control means includes circulation period detecting means for detecting a circulation period of said conveying means on the basis of the passage detection signal generated by said passage detecting means; and wherein said image data request signal generation means includes signal generation control means for controlling on the basis of the detected circulation period the generation interval between a first one of said image data request signals for forming the toner image or a first color of said different colors and a second one of said image data request signals for forming the toner image for a second color of said different colors.

Since the conveyance period detecting means detects directly the conveyance period of the recording medium, on which the toner image is being formed, or the conveyance period of the recording medium directly preceding it to control the positions where the toner images of two different colors are formed, it is possible to control positions, where a plurality of toner images of different colors are formed, with a high precision and thus to obtain a color image with an improved color registration.

DESCRIPTION OF THE PREFERRED EMBODIMENTS

Figure 1:
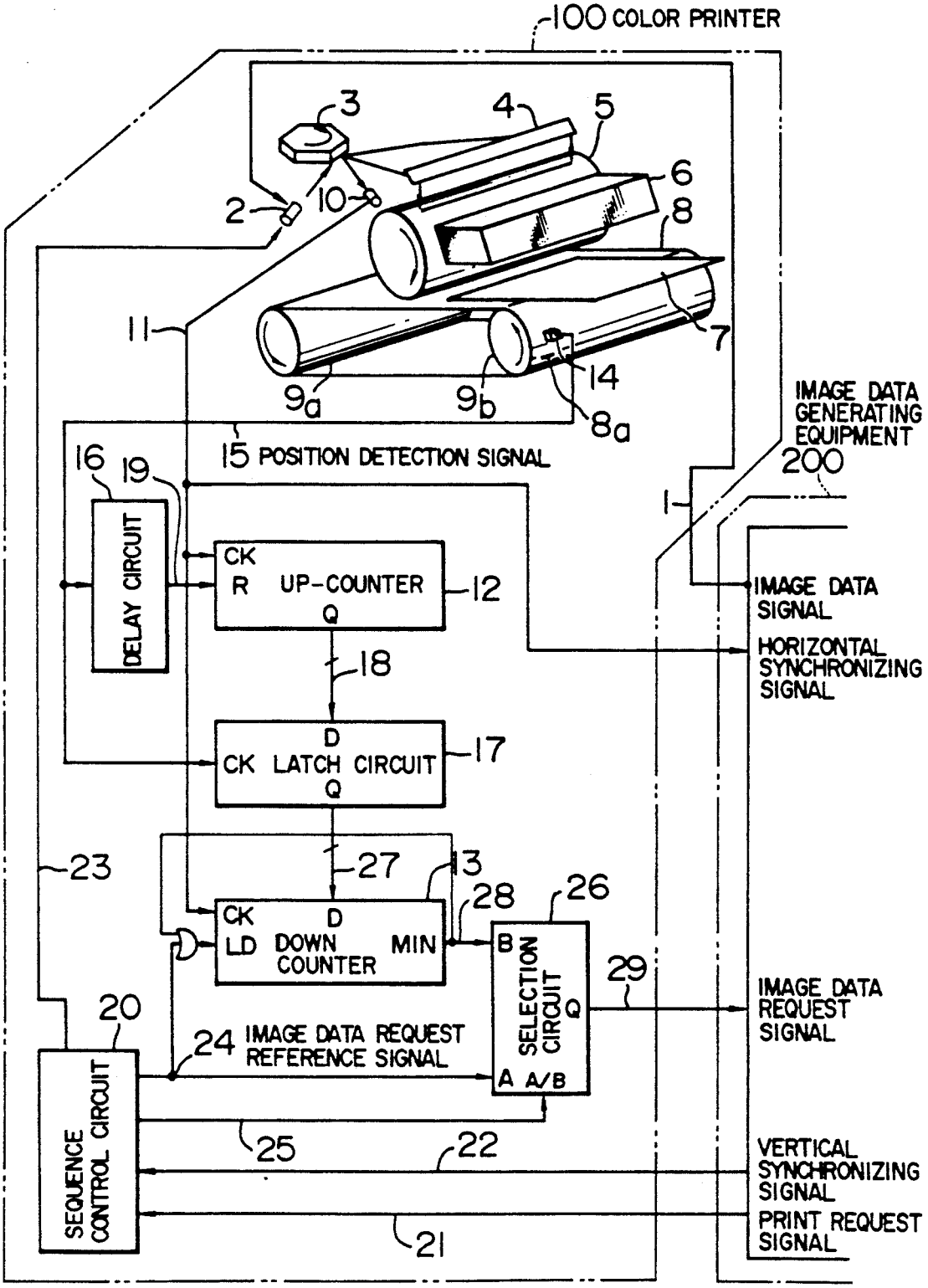
FIG. 1 is a control circuit diagram of a color printer system, which is an embodiment of the present invention.

FIG. 1 is a control circuit diagram of a color printer system according to the present invention, in which 100 represents a color printer and 200 an image data generating equipment such as a personal computer, an office computer, a file system or a word processor.

The color printer 100 is provided with a laser diode 2 turning on and off the generation of a light beam according to an image data signal 1 for each color transmitted by the image data generating equipment. Scanning means 3, including a rotating mirror, deflects the light beam outputted by the laser diode 2, which light beam is reflected by a reflecting mirror 4 so that the surface of a photo-sensitive. drum 5 is scanned therewith and exposed thereto. The surface of the photo-sensitive drum 5 is uniformly charged previously while being rotated with a constant speed in the direction indicated by the arrow and an electrostatic latent image is formed on the surface thereof by the exposure. Developing means 6 develops the electrostatic latent image on the surface of the photo-sensitive drum 5 to form a toner image on the surface. An endless sheet-conveying belt 8, conveying a recording sheet 7, is put over driving rollers 9*a* and 9*b*, rotated by a motor, to be circulated so that the toner image formed on the surface of the photo-sensitive drum 5 is transferred to the recording sheet 7.

A beam position detector 10 detects the light beam deflected by the scanning means described previously, when it passes through a scanning reference position, and generates a horizontal synchronizing signal 11, which is applied as a count clock signal to an up-counter 12 and a down-counter 13.

At a predetermined position on the conveyer belt 8, there is disposed a position detection mark 8*a* for detecting the position in the moving direction of the conveyer belt 8. There is disposed further a position detector 14 opposite the trajectory of the position detection mark 8*a*. The position detector 14 generates a position detection signal 15 when the position detection mark 8*a* passes through the position opposite thereto. This position detection signal 15 is inputted to a delay circuit 16 and to a latch circuit 17. The latch circuit 17 uses the position detection signal 15 as a latch clock signal and latches a count data (count value) signal 18 of the up-counter 12. On the other hand the delay circuit 16 delays the position detection signal 15 by a predetermined time before giving it to the up-counter 12 as a reset signal 19.

A sequence control circuit 20, managing the control of the whole color printer 100, receives a print request signal 21 and a vertical synchronizing signal 22 from image data generating equipment 200 and generates a drive period signal 23, an image data request reference signal 24, and a selection signal 25. The drive period signal 23 is given applied to the laser diode 2 and various sorts of drive motors; the image data request reference signal 24 is given applied to the down-counter 13 and to a selection circuit 26; and the selection signal 25 is given applied to the selection circuit 26. The down-counter 13 is loaded with a latch data (count value) signal 27 outputted by the latch circuit 17, using the image data request reference signal 24 as a load signal, and outputs a different color image data request signal 28, when the loaded count value is counted down to zero. The selection circuit 26 selects either the image data request reference signal 24 or the different color image data request signal 28 according to the selection signal 25 and gives it to the image data generating equipment 200 as the image data request signal 29.

The image data generating equipment 200 generates the print request signal 21 when it is desired to make the color printer 100 print out image data formed in the interior thereof, and when it receives the image data request signal 29, it generates an image data signal 1 in synchronism with the horizontal synchronizing signal 11, after having generated the vertical synchronizing signal 22.

Now the sequence control circuit 20 will be explained. In general, a printer has various driven portions, sensors or display portions, effects a recording process sequence, an error detection, a state detection or a state display, and further transmits and receives signals to and from the image data generating equipment. It is the sequence control circuit that performs these complicated processings. In a usual printer a 4 to 16 bit micro computer is used for this sequence control circuit. Further, since a memory element, a receiver, a driver, a clock generator, logic gates, etc. are naturally needed at the periphery of the microcomputer, they are also included in the sequence control circuit.

Also in the present embodiment, this sequence control circuit 20 is not a particular one, but it is a very general circuit as described above. However, in the present embodiment, concerning the signals transmitted to and received from the driven portion or the sensor or the image data generating equipment, only the pertinent signals are indicated.

Next the color image forming control will be explained, referring to FIG. 2.

When the print request signal 21 is generated by the image data generating equipment 200, the sequence control circuit 20 of the color printer 100 turns the drive period signal 23 to the low level to start the various drive motors. In this way the rotating mirror of the scanning means 3 begins to rotate, and the conveyer belt 8 begins also to rotate (in the state where no recording sheet is put thereon). At the same time the laser diode 2 is energized. The light beam outputted from the laser diode 2 is deflected by the scanning means 3 to scan drum 5 and to enter the beam position detector 10 which generates the horizontal synchronizing signal 11 that is inputted in the up-counter 12 and the down-counter 13.

On the other hand, a position detection signal 15 is outputted every time the detection mark 8*a* on the conveyer belt 8 passes through the position opposite the position detector 14 during every repeated conveyance period or belt circulation period, due to by the fact that the conveyer belt 8 is moved.

In such a state the sequence control circuit 20 controls a sheet supplying device (not shown in the figure) and takes out a recording sheet 7 from a sheet supplying cassette, which sheet is stopped at a predetermined position to wait. Then the sequence control circuit 20 generates the image data request reference signal 24 a predetermined period of time after the print request signal (including the printer action preparation time stated later), while the selection signal 25 remains at the high level state. The selection circuit 26 selects it and sends it to the image data generating equipment 200 as the image data request signal 29.

When the image data generating equipment 200 receives the image data request signal 29, it sends the vertical synchronizing signal 22 to the color printer 100 and generates the image data signal 1 of the first color in synchronism with the horizontal synchronizing signal 11 a predetermined period of time after the image data request signal 29. This is similar also for the second color.

When the sequence control circuit 20 of the color printer 100 receives the vertical synchronizing signal 22, it begins to convey the recording sheet, which has been in the stop and wait state described previously, to put the recording sheet on the conveyer belt 8. The surface portion of the conveyer belt 8 is made of a dielectric or semiconductor substance so that it can attract and convey the recording sheet 7 due to electrostatic force by charging it previously with the polarity opposite to that of the toner image.

The light beam outputted by the laser diode 2 is modulated according to the image data signal 1, deflected by the reflecting mirror 4, and projected to the surface of the photo-sensitive drum 5. The surface of the photo-sensitive drum 5 is exposed to form the electrostatic latent image. Thereafter this electrostatic latent image is developed with toner for the first color by developing means 6 so that the toner image of the first color is formed on the surface of the photo-sensitive drum 5. This toner image is rotated with the rotation of the photo-sensitive drum 5 and transferred to the recording sheet 7 that is conveyed by the conveyer belt 8 Since the polarity of charge of the toner and that of the conveyer belt 8 are opposite to each other, toner is attracted to the conveyer belt 8 side, which gives rise to this transfer. In this way the toner image of the first color is formed on the recording sheet 7 put on the conveyer belt 8.

The recording sheet 7 is moved, remaining attracted by the conveyer belt 8. In the same way as described above, the toner image of the second color is formed on the surface of the photo sensitive drum and transferred to the recording sheet 7, in registration with the toner image of the first color. Similarly the toner image of the third color is formed and transferred to the recording sheet 7.

Now the control for transferring the toner image of the second color and following to the recording sheet 7, in registration with the toner image of the first color formed thereon with high precision, will be explained.

The up-counter 12 counts always horizontal synchronizing signals 11 and is reset (zero-cleared) by the position detection signal 15 through the delay circuit 16. Consequently the up-counter 12 detects the conveyance period by counting the horizontal synchronizing signal 11. The count value of count data 18 from the up-counter 12, which has begun to count the horizontal synchronizing signal 11, based on the position detection signal (P1) 15, is latched in the latch circuit 17 by the succeeding position detection signal (P2) 15 (FIG. 2). On the other hand, this position detection Signal 15 is inputted to the up-counter 12 as the reset signal 19 through the delay circuit 16, giving rise to a small delay time. By this action, the up-counter 12 is reset and begins again the count. Between the reset of the up-counter 12 and the timing of the latching action of the latch circuit, the latter is always earlier owing to the function of the delay circuit 16. Consequently the data latched by the latch circuit 17 are represented by the value counted by the up-counter 12 before it is zero-cleared by the reset.

Now, these latching action and counting action are effected, every time the position detector 14 detects the position detection mark 8*a*, while the driving rollers 9*a* and 9*b* are rotated. The latch circuit 17 sends the count data signal 18 to the latch data signal 27 by latching action, which is inputted in the down-counter 13 as a data signal. The down-counter 13 does not read the latch data signal 27 stated above until the image data request signal 24 is inputted therein as a load input. Therefore, the down-counter 13 effects the down-count independently of the latch data signal 27 and continues to send a different color image data request signal 28 to the selection circuit 26, every time the count value becomes zero. However, the sequence control circuit 20 sends the selection signal 25 to the selection circuit 26 so that the different color image data request signal 28 is not selected so long as the image data request signal 24 for the first color is transmitted. Thus the signal 28 is not outputted as the image data request signal 29 from the selection circuit 26. In FIG. 2 it is shown that the selection signal 25 is at the high level at the points of time of P1 and P2.

Next the operation of transmitting the image data request signal 24 will be explained.

When the position detector 14 detects the position detection mark 8*a*, the detection signal appears in the position detection signal 15 in the form of a pulse train. At the point of time of P1, in the position detection signal 15 indicated in FIG. 2, sufficient time has already passed from the beginning of the rotation of the driving rollers 9*a* and 9*b* so that the rotation thereof has been reached a constant speed. Usually, since preparation time is necessary for driving the scanning means 3, transporting the recording sheet 7 from another place, until the image data request signal 24 for the first color is transmitted after the reception of the print request signal 21, if the driving source such as a motor, etc. is switched-on at the point of time where the print request signal 21 is received, for rotating the driving rollers 9*a* and 9*b*, generally the rotation is raised to a sufficient speed.

Figure 2:
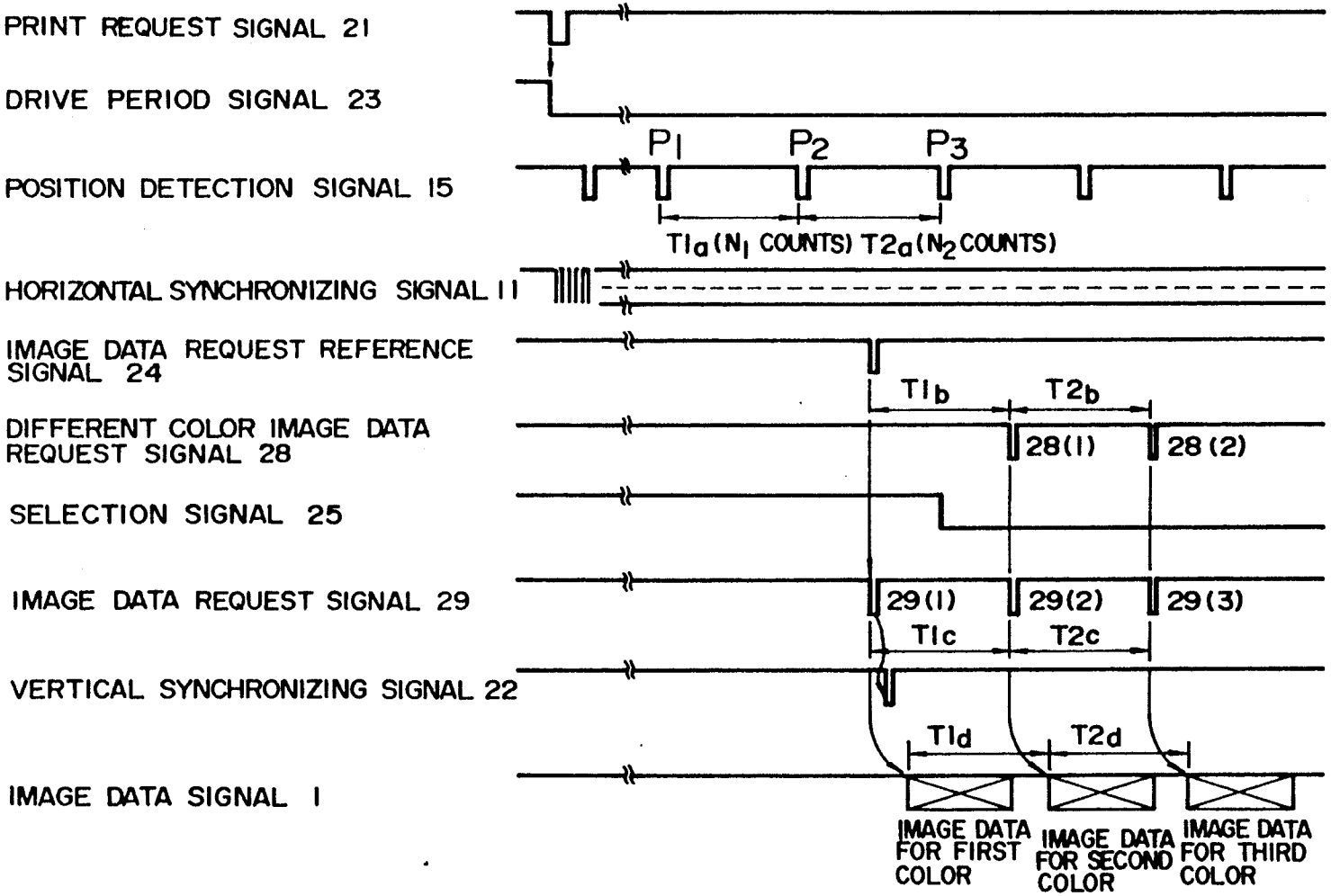
FIG. 2 is a time chart for the control of the color image formation.

In the example indicated in FIG. 2 the time difference (period of the recording sheet circulation) between the two position detection signals 15 P1 and P2 is Tla and the count value corresponding there-to is N1.

When the image data request reference signal 24, which requests the image data for the first color, is generated by the sequence control circuit 20 as described previously, the down-counter 13 is loaded with the latch data signal 27 directly before the output from the latch circuit 17, i.e. N1, in synchronism with the image data request reference signal 24, and begins to downcount, using the horizontal synchronizing signal 11 as a clock signal. When the count value reaches zero, down counter 13 generates the different color image data request signal 28 (1). Meanwhile the selection circuit 26 transmits the different color image data request signal 28 (1) outputted by the down-counter 13 to the image data generating equipment 200 as the image data request signal 29 (2) for the second color, and the following, by controlling the selection signal 25 to the low level. Consequently the signal 28 (1) is a signal outputted when a period of time Tlb has passed, which is necessary for down-counting to zero from the point of time where the down-counter takes-in the latch data N1 by the reference signal 24.

Since the time difference Tlb from the point of time where the image data request reference signal 24 is selected by the selection circuit 26 and transmitted to the image data generating equipment 200 as the image data request signal 29 (1) for the first color to the point of time where the different color image data request signal 28 (1) is generated is almost equal to the recording sheet conveyance period Tla by the conveyer belt 8 measured by the up-counter 12, the time difference between the image data request signal 29 (1) for the first color transmitted from the color printer 100 to the image data generating equipment 200 and the image data request signal 29 (2) for the second color is almost equal to the directly preceding recording sheet conveyance period Tla by the conveyer belt 8. Therefore the image data generating equipment 200 can detect the position of the toner image of the first color with a higher precision and generate the image data signal 1 for forming the toner image of the second color, which should be formed in precise registration thereon, after a time difference Tld, which is equal to the recording sheet conveyance period.

By the way, in contrast with to the fact that the time difference (recording sheet conveyance period) T1 has an order of magnitude of several seconds to ten plus several seconds,.the generation period of the horizontal synchronizing signal 11 has an order of magnitude of several hundred μs to several ms, and therefore there is a difference as great as $10^4$ therebetween. Consequently digital errors have an order of magnitude of about $1/10^4$ and it can be understood that it is possible to perform the control with an extremely high precision. The control for forming the toner image of the third color is performed in the same way by down-counting the recording sheet conveyance period T2a (count value N2), generating the signal 28(2) after the lapse of the time T2b and transmitting it to the image data generating equipment 200 as the image data request signal 29(3).

When the formation of the color image on the first sheet is terminated by the method described above, a second recording sheet, which has been in the stop and wait state, is put on the conveyer belt and dealt with in the same manner.

Further, although the selection circuit 26 is used in the embodiment described above, the circuit may be removed and the different color image data request signal 28 may be directly inputted in the equipment 200.

In the embodiment described above, since the just preceding recording sheet conveyance or circulation period is always measured and the beginning timing of the generation of image data .signals for the formation of toner images of various colors is controlled on the basis of results obtained by this measurement, it is possible to form and print toner images of different colors in registration with each other with a high precision.

Now concrete examples and modified examples will be explained, referring to FIGS. 3 to 8.

Figure 3:
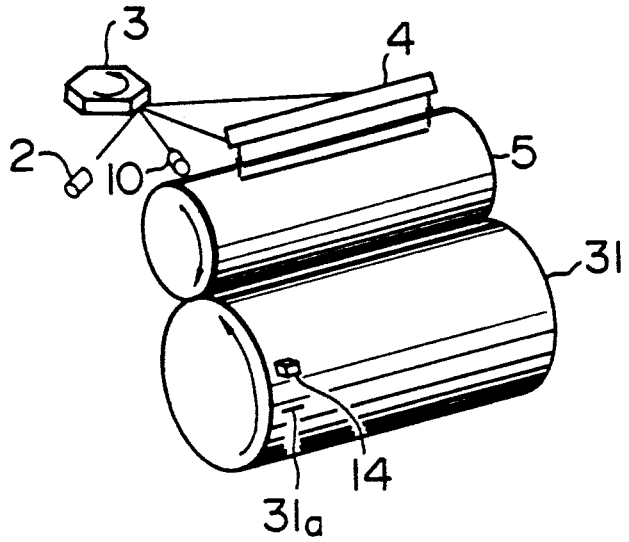
FIG. 3 is a perspective view of a modified example of the recording sheet conveying means.

FIG. 3 shows a modified example, in which a transferring drum 31 is used as conveying means for conveying a recording sheet 7. A dielectric or semiconductor layer is formed on the outer peripheral surface of a conductive substrate of this transferring drum 31, which is charged in the same way as the conveyer belt 8 so that the recording sheet 7 is attracted electrostatically and conveyed. The position detection mark 31*a* is disposed at an end portion of the outer peripheral surface of the transferring drum 31.

In the case of the conveyer belt 8 described above, since the curvature varies in the course of the conveyance, slight positional divergences can be produced between the conveyer belt 8 and the recording sheet 7. In contrast with the transferring drum 31, since such divergences are not produced, the positional precision is improved.

Figure 4:
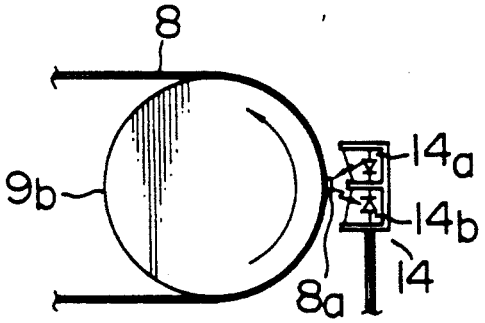
FIG. 4 is a side view illustrating a concrete example of the position detecting means.

FIG. 4 shows a concrete example of the position detecting means. The position detection mark 8*a* disposed on the conveyer belt 8 is a white mark, and the position detector 14 is a reflection type interrupter composed of a light emitting diode 14*a* and a photosensitive element 14*b* such as a PIN photodiode or a phototransistor. When the position detection mark 8*a* is opposite the position detector 14, it reflects light from the light emitting diode 14*a*, and the photosensitive element 14*b* detects the reflected light to generate the position detection signal 15.

Figure 5:
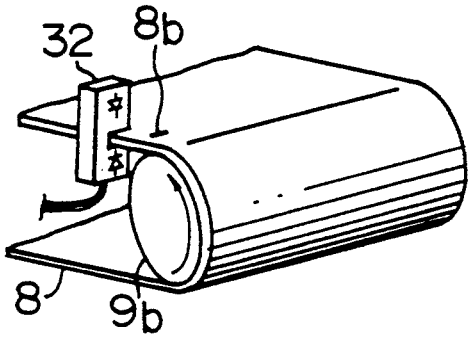
FIGS. 5 and 6 are perspective views illustrating modified examples of the position detecting means.

FIG. 5 shows a modified example of the position detecting means. In this modified example a slit formed in the conveyer belt 8 acts as the position detection mark 8*b* and a transmission type interrupter 32 is used for the position detector 14.

Further the position detecting means indicated in FIGS. 4 and 5 can be applied also to the device using the transferring drum type conveying means explained with reference to FIG. 3.

Figure 6:
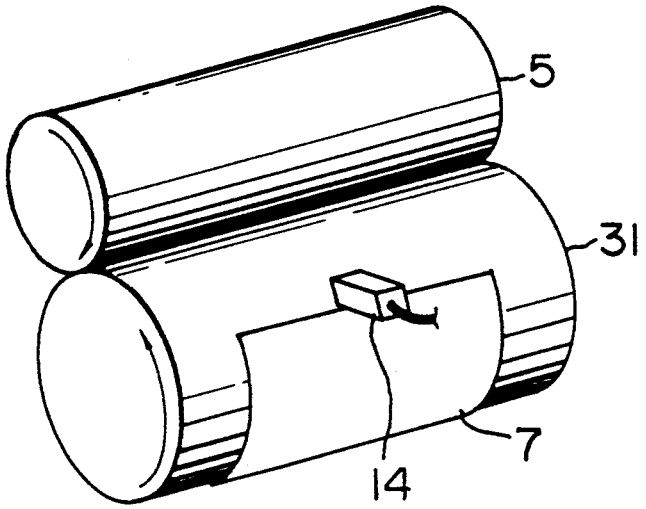

FIG. 6 shows a modified example, in which the front end of the recording sheet 7 conveyed by the transferring drum explained with reference to FIG. 3, is detected by a reflection type position detector 14 to generate the position detection signal 15. This modified example can be applied to the case of recording sheet conveyance by a conveyer belt type conveying means, as explained with reference referring to FIG. 1.

Figure 7:
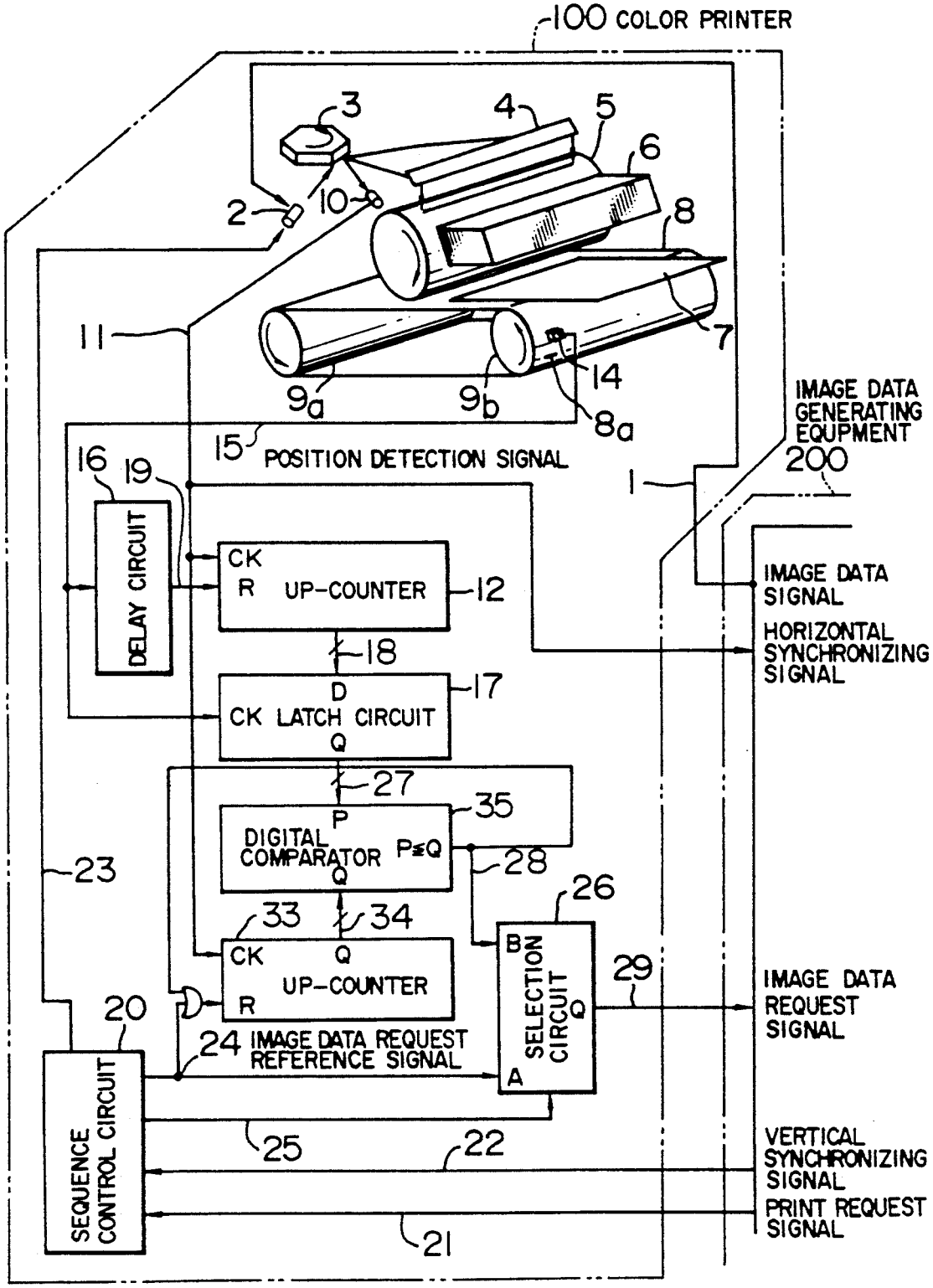
FIG. 7 is a circuit diagram showing a modified example of the control circuit.
Figure 8:
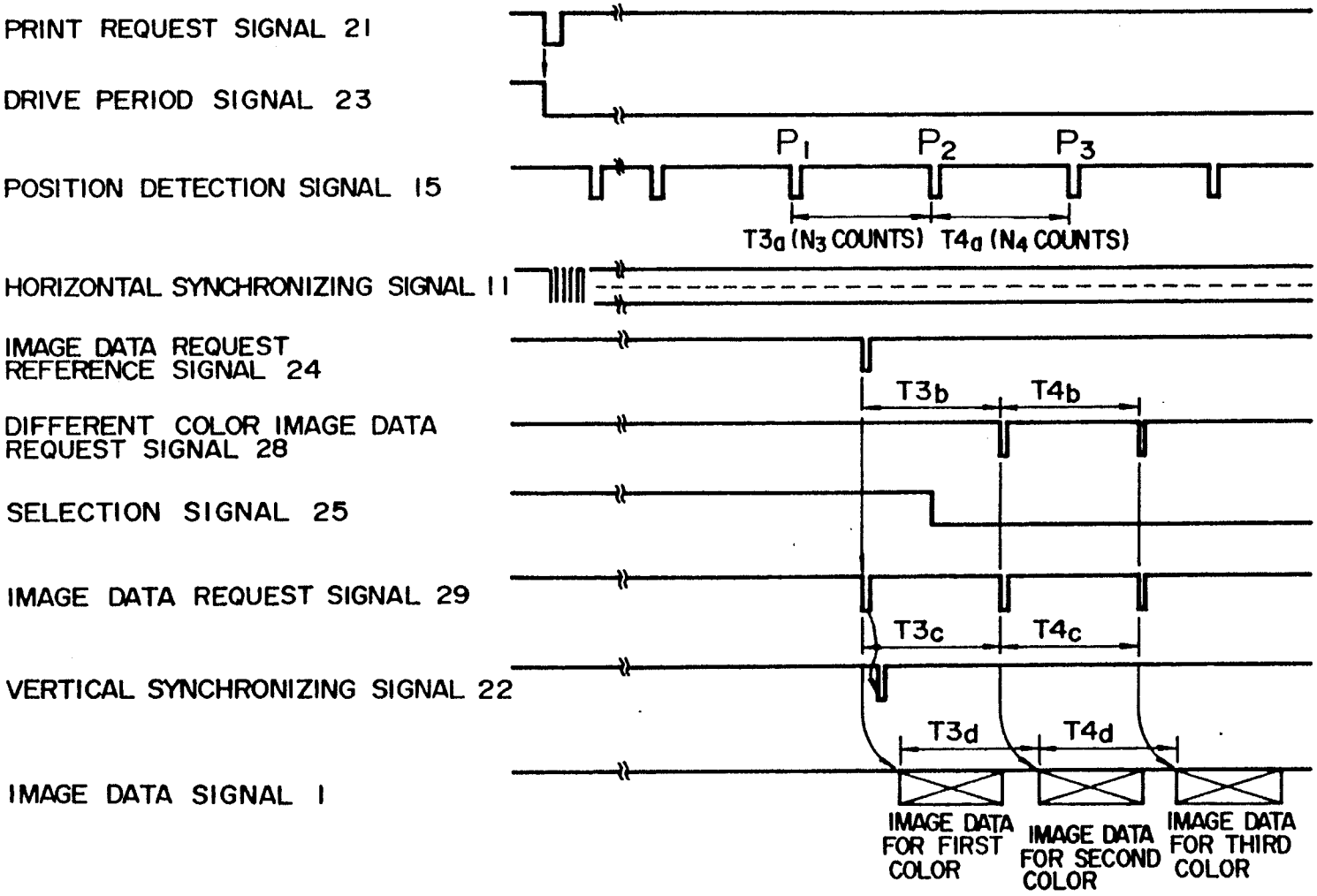
FIG. 8 is a time chart for the control thereof.

FIGS. 7 and 8 depict a modified example of the control circuit and a control time chart therefor. The difference thereof from the control indicated in FIG. 1 consists in that an up-counter 33 is used instead of the down-counter 13; the count data signal 34 of the up-counter 33 and the latch data signal 7 outputted by the latch .circuit 17 are compared by a digital comparator 35; and when the both are equal to each other, or the former is greater than the latter, the different color image data 28 is outputted.

In this embodiment an advantage is obtained that the recording sheet conveyance period T3a, detected when the image data request signal 29 is generated to request the image data signal for the first color, can be equal to the time difference T3c between the image data request signals 29 for the first and the second color, and that it is possible to control the generation period of the image data signal 1 by using the recording sheet conveyance period data, which is closer in time sequence to the generation of the signals.

The control operation thereof will be explained, referring to FIG. 8. The latch circuit 17 latches the count data signal 18 outputted by the up-counter 12, every time the position detection signal 15 is generated, and sends the latch data signal 27 to a digital comparator 35 as the newest recording sheet conveyance period data. The up-counter 33 is reset, when the sequence control circuit 20 generates the image data request reference signal 24 for forming the toner image of the first color and thereafter begins to count horizontal synchronizing signals 11. When the position detection signal 15 is next generated in the course of the count operation, the latch circuit 17 latches the current count data signal 18, outputted at that time by the up-counter 12, and sends it to the digital comparator 35 as the latch data signal 27. These data are T3a as the time difference, having N3 as count value. At this time up-counter 3 continues the count and sends always the count value to the digital comparator 35 as the count data signal 34. When this count data (count value) signal 34 becomes equal to the current latch data (count value N3) signal 27 or greater, the digital comparator 35 generates the different image data request signal 28. Consequently the time difference T3b is equal to the time difference T3a, i.e. the count value N3, and finally the time difference (image data generation period) T3d is equal to the same time difference (recording sheet conveyance period) T3a. The control for the third color and the followings is effected in the same way.

In the embodiment indicated in FIG. 1, since the belt conveyance period measured by the up-counter 12 is outputted by the latch circuit 17 and down-counted to zero by the down-counter 13, it is necessary to detect the conveyance period before the generation of the image data request signal 29 for the first color. In contrast, the embodiment depicted in FIG. 7, since the count outputs of the two up-counters 12 and 33 are compared, to order the image data request signal for the second color it is possible to utilize a counted value of the up-counter 12 at an optional time when the control circuit 20 may output an image data request signal 24 for the image data of the first color. Further it is possible to make the belt measurement regions of both the counters closer to each other and to raise the measurement precision of the conveyance period. Thus the embodiment of FIG. 7 is more effective and useful than that of FIG. 1 in the case of slow or retard rise-up states of the drive motors.

Although, in the above, the control for forming a color image of three colors has been explained, the formation of a color image of more than three colors can be controlled in the same way. In the case of the formation of a monochromatic toner image, it is sufficient to omit the control for the second color and the following.

Further, if the up-counter and the down-counter described above are made to count a faster reference clock signal other than the horizontal synchronizing signal, digital control errors become smaller.

In the above only the control until the toner image is transferred to the recording sheet 7 has been explained. Since for the construction for separating the recording sheet 7, to which the toner image is transferred, from the conveyer belt 8 or the transferring drum 31, and developing and ejecting it are the same as that used in a prior art device, explanation thereof is omitted.

As described above, according to the present invention, since the recording medium conveyance period in the course of the toner image formation or the recording medium conveyance period directly preceding it is directly detected, it is possible to control positions, where a plurality of toner images of different colors are formed, with a high precision and thus to obtain a color image with satisfactory and reliable color registration.

We claim:

1. A color printer, for use with color image data generating means which sequentially generates color image data corresponding to different colors of a multi-color image, for printing the multi-color image on a recording medium, said color printer comprising:

a photo-sensitive body adapted to circulate in response to a print request signal from the color image data generating means;

electrostatic latent image forming means for forming on said circulating photo-sensitive body an electrostatic latent image of color image data received from the color image data generating means and corresponding to a respective color of the multi-color image;

developing means for developing the electrostatic latent image formed on said photo-sensitive body to form thereon a one-color toner image of the received color image data;

conveying means for circulating a recording medium in synchronism with the circulating photo-sensitive body for transfer to the recording medium of the one-color toner image on said circulating photo-sensitive body; and image data request signal generation means for sequentially generating and applying image data request signals to the image data generating means, to request generation of color image data corresponding to a respective color of the multi-color image, said image data request signal generation means including:

(a) image data request reference signal generating means responsive to the print request signal for generating an image data request reference signal;

(b) clock means for generating a clock signal;

(c) passage detecting means, responsive to each passage of a particular portion of said conveying means through a predetermined position during circulation of the recording medium, for generating passage detection signals;

(d) first measuring means, responsive to the clock signal and to each passage detection signal, for measuring each respective circulation period of the recording medium on said conveying means between successive passage detection signals and for providing an output signal indicative thereof;

(e) second measuring means, responsive to the clock signal and each output signal from said first measuring means, for controlling a synchronization interval for each respective image data request signal, each synchronization interval having a duration determined by the respective circulation period measured by said first measuring means, said second measuring means being responsive to termination of the synchronization interval for initiating a subsequent synchronization interval; and (f) means for generating a first image data request signal in response to the image data request reference signal and for generating a subsequent image data request signal in response to termination of the synchronization interval, so that the application to the image data generating means of each image data request signal subsequent to said first image data request signal occurs at a time synchronizing the circulation of said photo-sensitive body having the developed electrostatic image thereon with the circulation of the recording medium on said conveying means to cause sequential transfer of color toner images to the recording medium in registry to form a multi-color image on the recording medium.

2. A color printer according to claim 1, wherein said conveying means comprises two oppositely positioned rollers and an endless conveyer belt positioned around said rollers.

3. A color printer according to claim 2, wherein said position detecting means comprises light reflecting means disposed on said conveyer belt and a reflection type interrupter for projecting light to said light reflecting means and detecting reflected light.

4. A color printer according to claim 2, wherein said position detecting means comprises a slit formed in said conveyer belt and a transmission type interrupter disposed opposite said slit.

5. A color printer according to claim 1, wherein said photo-sensitive body comprises a photo-sensitive drum, and said conveying means comprises a transferring drum rotated in contact with said photo-sensitive drum.

6. A color printer according to claim 5, wherein said position detecting means comprises a reflection type interrupter disposed for detecting the front edge of the recording medium conveyed by said transferring drum.

7. A color printer, for use with color image data generating means which sequentially generates color image data corresponding to different colors of a multi-color image, for printing the multi-color image on a recording medium, said color printer comprising:

a photo-sensitive body adapted to circulate in response to a print request signal from the color image data generating means;

electrostatic latent image forming means for forming on said circulating photo-sensitive body an electrostatic latent image of color image data received from the color image data generating means and corresponding to one color of the multi-color image;

developing means for developing the electrostatic latent image formed on said photo-sensitive body to form thereon a one-color toner image of the received color image data;

conveying means for circulating a recording medium in synchronism with the circulating photo-sensitive body for transfer to the recording medium of the one-color toner image on said circulating photo-sensitive body; and image data request signal generation means for sequentially generating and applying image data request signals to the image data generating means, to request generation of color image data corresponding to a respective color of the multi-color image, said image data request signal generation means including:

(a) image data request reference signal generating means responsive to the print request signal for generating an image data request reference signal;

(b) clock means for generating a clock signal;

(c) passage detecting means, responsive to each passage of a particular portion of said conveying means through a predetermined position during circulation of the recording medium, for generating passage detection signals;

(d) first measuring means responsive to the clock signal and to each passage detection signal, for measuring each respective circulation period of the recording medium on said conveying means between successive passage detection signals;

(e) second measuring means responsive to the clock signal for controlling a synchronization interval for the image data request signals, each synchronization interval having a duration determined by the circulation period measured by said first measuring means just prior to initiation of that synchronization interval, said second measuring means being responsive to termination of the synchronization interval for initiating a subsequent synchronization interval; and (f) means for generating a first image data request signal in response to the image data request reference signal and for generating a subsequent image data request signal in response to termination of the synchronization interval, so that the application to the image data generating means of each image data request signal subsequent to said first image data request signal occurs at a time synchronizing the circulation of said photo-sensitive body having the developed electrostatic image thereon with the circulation of the recording medium on said conveying means to cause sequential transfer of color toner images to the recording medium in registry to form a multi-color image on the recording medium.

8. A color printer according to claim 7, wherein:

said first measuring means comprises a resettable up-counter for counting up the clock signals, delay means responsive to the passage detection signal for resetting said up-counter at a predetermined time after the passage detection signal, and latch means responsive to each passage detection signal for latching the count value of said up-counter as a measurement of the circulation period; and said second measuring means comprises a down-counter responsive to the clock signal for counting down to zero from the count value in said latch means at the termination of a synchronization interval, to terminate the synchronization interval.

9. A color printer according to claim 8, wherein said clock means generates the clock signal at a horizontal-sync frequency.

10. A color printer, for use with color image data generating means which sequentially generates color image data corresponding to different colors of a multi-color image, for printing the multi-color image on a recording medium, said color printer comprising:

a photo-sensitive body adapted to circulate in response to a print request signal from the color image data generating means;

electrostatic latent image forming means for forming on said circulating photo-sensitive body an electrostatic latent image of color image data received from the color image data generating means and corresponding to one color of the multi-color image;

developing means for developing the electrostatic latent image formed on said photo-sensitive body to form thereon a one-color toner image of the received color image data;

conveying means for circulating a recording medium in synchronism with the circulating photo-sensitive body for transfer to the recording medium of the one-color toner image on said circulating photo-sensitive body; and image data request signal generation means for sequentially generating and applying image data request signals to the image data generating means, to request generation of color image data corresponding to a respective color of the multi-color image, said image data request signal generation means including:

(a) image data request reference signal generating means responsive to the print request signal for generating an image data request reference signal;

(b) clock means for generating a clock signal;

(c) passage detecting means, responsive to each passage of a particular portion of said conveying means through a predetermined position during circulation of the recording medium, for generating passage detecting signals;

(d) first measuring means responsive to the clock signal and to each passage detection signal, for measuring each respective circulation period of the recording medium on said conveying means between successive passage detection signals;

(e) second measuring means responsive to the clock signal for controlling a synchronization interval for the image data request signals, each synchronization interval having a duration determined by the circulation period being measured by said first measuring means when that synchronization interval is initiated, said second measuring means being responsive to termination of the synchronization interval for initiating a subsequent synchronization interval; and (f) means for generating a first image data request signal in response to the image data request reference signal and for generating a subsequent image data request signal in response to termination of the synchronization interval, so that the application to the image data generating means of each image data request signal subsequent to said first image data request signal occurs at a time synchronizing the circulation of said photo-sensitive body having the developed electrostatic image thereon with the circulation of the recording medium on said conveying means to cause sequential transfer of color toner images to the recording medium in registry to form a multi-color image on the recording medium.

11. A color printer according to claim 10 wherein:

said first measuring means comprises a first resettable up-counter for counting up the clock signals, delay means responsive to the passage detection signal for resetting said first resettable up-counter at a predetermined time after the passage detection signal, and latch means responsive to each passage detection signal for latching the count value of said first resettable up-counter as a measurement of the circulation period; and said second measuring means comprises a second resettable up-counter for counting up the clock signals, means responsive to termination of a synchronization interval for resetting said second resettable up-counter, and a comparator for terminating the synchronization interval when the count value in said latch means is equal to or less than the count value in said second resettable up-counter.

12. A color printer according to claim 11, wherein said clock means generates the clock signal at a horizontal-sync frequency.

* * * * *